US009140066B2

(12) United States Patent
Lanzl et al.

(10) Patent No.: US 9,140,066 B2
(45) Date of Patent: Sep. 22, 2015

(54) CONSTRUCTION WORK UNIT AND METHOD FOR ERECTING A MAST

(75) Inventors: Martin Lanzl, Schrobenhausen (DE); Manfred Angermeier, Karlskron (DE); Josef Haas, Schrobenhausen (DE); Christoph Wittmann, Ingolstadt (DE); Christian Miehling, Titting (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 568 days.

(21) Appl. No.: 13/492,529

(22) Filed: Jun. 8, 2012

(65) Prior Publication Data

US 2013/0140091 A1 Jun. 6, 2013

(30) Foreign Application Priority Data

Jun. 9, 2011 (EP) ..... 11004737

(51) Int. Cl.
*B66C 23/06* (2006.01)
*E21B 7/02* (2006.01)

(52) U.S. Cl.
CPC .. *E21B 7/02* (2013.01); *E21B 7/023* (2013.01)

(58) Field of Classification Search
CPC ..... E21B 7/02; E21B 7/023
USPC ..... 52/111, 112, 114, 116, 117, 119, 121
See application file for complete search history.

(56) References Cited

U.S. PATENT DOCUMENTS

| | | | | |
|---|---|---|---|---|
| 6,533,045 | B1 * | 3/2003 | Cooper | 173/28 |
| 8,002,048 | B2 * | 8/2011 | Saehn et al. | 173/184 |
| 2006/0180325 | A1 | 8/2006 | Stoetzer | |
| 2008/0202812 | A1 * | 8/2008 | Childers et al. | 175/52 |
| 2009/0139731 | A1 | 6/2009 | Rieder et al. | |
| 2009/0314547 | A1 | 12/2009 | Stoetzer et al. | |
| 2010/0276385 | A1 | 11/2010 | Pech et al. | |

FOREIGN PATENT DOCUMENTS

| | | | |
|---|---|---|---|
| CN | 1773073 | A | 5/2006 |
| DE | 44 36 264 | C1 | 11/1995 |
| DE | 20 2007 010 562 | U1 | 10/2007 |
| EA | 013805 | B1 | 8/2010 |
| EP | 1655 415 | A1 | 5/2006 |
| EP | 1 884 619 | A1 | 2/2008 |

(Continued)

OTHER PUBLICATIONS

European Search Report dated Feb. 20, 2012; EP Application No. 11 00 4737.

*Primary Examiner* — Mark Wendell
(74) *Attorney, Agent, or Firm* — Studebaker & Brackett PC

(57) ABSTRACT

A drilling unit, with a carrier vehicle, a mast rotatably mounted on the carrier vehicle about a pivot axis, which mast can be pivoted between an erect operating position and an inclined transport position, and at least one erection cylinder for pivoting the mast between the operating position and the transport position. For pivoting the mast in addition to the at least one erection cylinder an erection cable is provided which is guided via a cable deflection pulley arranged on the mast, on the carrier vehicle or on a carriage which can be moved along the mast, and in that in order to apply a pulling force to the erection cable via the cable deflection pulley an erection force can be transferred to the mast in the direction of its operating position. The invention further relates to a method for erecting a mast of a construction work unit.

15 Claims, 3 Drawing Sheets

(56) References Cited

FOREIGN PATENT DOCUMENTS

| | | | |
|---|---|---|---|
| EP | 1 978 204 | A1 | 10/2008 |
| EP | 1983147 | A2 | 10/2008 |
| EP | 2067923 | A1 | 6/2009 |
| EP | 2 133 508 | A1 | 12/2009 |
| JP | H06-219684 | A | 8/1994 |
| JP | 2519664 | B2 | 7/1996 |
| JP | 2000-248545 | A | 9/2000 |
| JP | 2001-40663 | A | 2/2001 |
| JP | 2009-030423 | A | 2/2009 |
| SU | 130010 | A1 | 11/1960 |

* cited by examiner

CONSTRUCTION WORK UNIT AND METHOD FOR ERECTING A MAST

FIELD OF THE INVENTION

The invention relates to a construction work unit and to a method for erecting a mast of a construction work unit. More particularly, the invention relates to a construction work unit, in particular drilling unit, with a carrier vehicle, a mast mounted on the carrier vehicle rotatably about a pivot axis, which mast can be pivoted between an erect operating position and an inclined transport position, and at least one erection cylinder for pivoting the mast between the operating position and the transport position.

DESCRIPTION OF RELATED ART

A generic construction work unit which can in particular be a drilling unit comprises a carrier vehicle, a mast mounted rotatably on the carrier vehicle about a pivot axis, which mast can be pivoted between an erect operating position and an inclined transport position, and at least one erection cylinder for pivoting the mast between the operating position and the transport position.

The inventive method relates to the erection of a mast of a construction work unit which comprises a carrier vehicle and a mast connected to the carrier vehicle which can be pivoted between an erect operating position and an inclined transport position. It is provided for erection of the mast that at least one erection cylinder is actuated.

The erection cylinder or the erection cylinders, which are also generally described as neck cylinders, serve on the one hand to support the mast during the drilling operation and on the other hand to erect the mast. In the known drilling units with a tiltable mast the mast length is limited by the necessary moment for erecting the mast. For this reason the erection cylinders are often over-dimensioned for the drilling operation as the forces for erecting the mast are considerably greater than the forces for supporting the mast during the drilling operation. Often the maximum admissible hydraulic pressure in the neck or erection cylinders must also be dimensioned especially for the erection of the mast.

SUMMARY OF THE INVENTION

It is an object of the invention to indicate a construction work unit and a method for erecting a mast which facilitate a simple erection of the mast under economical conditions.

This object is achieved according to the invention through a construction work unit having the features of claim 1 and through a method having the features of claim 13. Preferred embodiments of the invention are indicated in the dependent claims.

The construction work unit is characterised according to the invention in that for pivoting the mast in addition to the at least one erection cylinder an erection cable is provided which is guided via a cable deflection pulley arranged on the mast and can be arranged on the one hand on the carrier vehicle and on the other hand on a carriage which can be moved along the mast and in that by applying a pulling force to the erection cable via the cable deflection pulley an erection force can be transferred to the mast in the direction of its operating position.

The inventive method is characterised in that for the erection of the mast in addition to the erection cylinder an erection cable is used which is arranged on the one hand on the carrier vehicle and on the other hand on a carriage and is guided via a cable deflection pulley arranged on the mast and in that a pulling force is applied to the erection cable, wherein in order to erect the mast via the cable deflection pulley an erection force is transferred to the mast.

The invention relates in particular to a drilling unit with a mast which can be tilted forwards. Through the inventive erection cable for supporting the erection of the mast the neck or erection cylinder can be relieved and thus be made with smaller dimensions. On the other hand it is possible to erect a longer mast with the same size of the erection cylinder.

A core idea of the invention consists in that in addition to the at least one erection cylinder a further erection drive is provided. This further drive for erecting the mast comprises a cable and can thus also be described as a cable or erection cable drive. In order to erect the mast the erection cable is fixed according to the invention on the one hand on the carrier vehicle and on the other hand on a carriage which is mounted so that it can be displaced along the mast.

The erection force is provided according to the invention in particular in that a pulling force acts on the cable at least at one end of the cable and moves the cable so that a distance between a connection point of the cable on the carrier vehicle and the cable deflection pulley is shortened.

An erection force is to be understood in particular to be a force which is orientated so that an erection of the mast from its, in particular horizontal, transport position in the direction of the, in particular vertical, operating position is brought about. The erection force through the erection cable acts in particular in addition to a further erection force which can be produced by the at least one erection cylinder.

The erection cable is preferably guided starting from a first connection point on the carrier vehicle via the cable deflection pulley to a second connection point on the carriage in such a way that through the pulling force applied to the cable a force extending obliquely to the longitudinal axis of the mast can be exerted on the mast which brings about a raising or erecting of the mast. The opposite ends of the erection cable can hereby be arranged on the carrier vehicle and the carriage, in particular can be fixed and/or connected.

The construction work unit can be in particular a mobile drilling unit. The carrier vehicle of the construction work unit can comprise in particular an undercarriage, possibly with a caterpillar, and an upper structure which is arranged rotatably on the undercarriage. For transport purposes of the construction work unit it is usual to pivot the mast into a substantially horizontal transport position. The mast is preferably mounted pivotably on the upper structure. The erection cable can also be arranged on or fixed to the upper structure of the carrier vehicle.

The pulling force can be achieved in particular through a movement of the carriage, on which the erection cable is arranged. By moving the carriage an erection force can thus be exerted on or transferred to the mast which can be introduced in particular via the cable deflection pulley mounted on the mast into the mast. The movement of the carriage thus causes a force which can be exerted on the deflection pulley and which is orientated in the direction of the operating position of the mast.

In order to apply the pulling force to the erection cable, in particular to move the carriage along the mast, a feed drive or carriage drive is preferably provided. By moving the carriage along the mast it is thus possible via the erection cable for an erection force to be transferred to the mast in the direction of its operating position. The feed drive is present in particular in addition to the at least one erection cable, that is to say the erection cable does not work as a feed drive. By moving the carriage by means of the feed drive, due to its coupling with the erection cable, a pulling force can be exerted on the cable.

The feed drive preferably comprises a chain or cable drive and/or a hydraulic feed cylinder.

The chain or cable drive can comprise in particular a drive chain and/or a drive cable. For example the carriage can be coupled, besides the erection cable, with a further cable, a feed or drive cable, which can for example exert a feed force on the carriage via a feed cable winch.

Through a hydraulic feed cylinder a particularly compact carriage drive can be provided. The feed or actuating cylinder can be connected on the one hand to the carriage and on the other hand to the mast. The in particular hydraulic or pneumatic actuating cylinder can comprise in the principally known way a cylinder housing and a piston guided displaceably therein. The actuating cylinder can be arranged in particular so that by moving out the piston the carriage is moved in the direction of the mast base.

A particularly reliable and compact device is achieved in that the erection cable is fixed to two connection points, between which a predefined or fixed cable length is formed. The cable is in this connection preferably fixed at its opposing ends to corresponding cable fixed points on the carriage and on the carrier vehicle.

A first part length of the erection cable is preferably formed between a first connection point of the erection cable on the carrier vehicle and the cable deflection pulley and a second part length of the erection cable between a second connection point of the erection cable on the carriage and the cable deflection pulley. By moving the carriage along the mast the first part length can be shortened and, in particular simultaneously, the second part length can be lengthened correspondingly, thus to the same extent, or vice versa. Through this arrangement a particularly compact and effective device is achieved for supporting the erection of a mast.

The inventive shortening and lengthening of the two part lengths can be achieved in particular in that the connection point of the erection cable on the carrier vehicle in the operating position of the mast is closer to the cable deflection pulley than in the transport position. As the erection cable is guided in particular directly from the first connection point to the deflection pulley the first part length is shortened through an erection of the mast while it is lengthened through a lowering of the mast.

The second part length can be lengthened in particular by moving the carriage in the direction of the mast base and shortened by moving the carriage in the direction of the mast head. The overall length of the erection cable, put together from both part lengths, between the connection points remains preferably equal.

In order to provide the erection force it is preferable for a vehicle-side connection point of the erection cable, the cable deflection pulley and a carriage-side connection point of the erection cable to form a triangle in the inclined transport position of the mast. The inclined transport position of the mast thereby refers in particular to a horizontal position of the mast and/or a position of the mast inclined with respect to the vertical. An erection moment can be produced through the triangle.

According to the invention it is preferable for applying the pulling force to the erection cable for a winch to be provided for winding up the erection cable. The erection force is thereby produced through the winding of the erection cable onto the winch. By winding the erection cable onto the winch when the carriage is fixed the distance between the winch and the cable deflection pulley is shortened and thus an erection force applied via the cable deflection pulley to the mast in the direction of its operating position. In principle it is thereby also possible that in addition to winding the erection cable onto the winch the carriage is moved in the direction of the mast base. The arrangement of the end of the erection cable lying opposite the winch on the carriage facilitates a simple release of the cable if the mast is in the operating position. In this connection the carriage can be moved for example for improved accessibility in the direction of the mast base. The erection cable released by the carriage can then be available for other purposes. In particular the erection cable can be the so-called main cable and the winch the so-called main winch of the construction work unit. The main or erection cable can be used during the drilling operation of the construction work unit, for example for handling drill rod components. According to the invention the erection cable can, however, also be arranged on the mast in principle instead of on the carriage.

A constructively favourable embodiment is achieved if the erection cable is arranged on the carrier vehicle above the pivot axis of the mast. The further the erection cable is from the pivot axis on the carrier vehicle the more favourable is a force triangle thus produced.

It is particularly preferable that the erection cable extends between the carrier vehicle and the cable deflection pulley approximately parallel to the at least one erection cylinder. A particularly favourable support of the erection force caused by the erection cylinder is hereby achieved.

It is further preferable for the cable deflection pulley to be arranged at a position, spaced apart from the mast head, in a central region of the mast. A central region of the mast is thereby to be understood in particular as a region between the mast head and the mast base. Through the arrangement of the cable deflection pulley away from the mast head an improvement in the force triangle and thus a more effective supporting of the erection of the mast is achieved. It is particularly preferable if the deflection pulley is arranged in the region of a connection point of the erection cylinder on the mast.

According to a further preferred embodiment of the invention the erection cable is fixed releasably to the carriage. In order to secure the mast in the erect operating position the erection cable released from the carriage can be arranged on the mast. The erection cylinders or neck cylinders usually also serve for the securing of the mast in the operating position. Through the erection cable attached to the mast this can serve during the drilling operation as additional security for the mast in case of failure of the neck cylinders.

It is particularly preferable for the carriage to be formed as a drilling unit carriage, to which a drill drive for driving a drill rod can be fixed. The carriage is thus used, so to speak, for the drilling operation, thus for moving the drill drive, and for erecting the mast. No independent, additional carriage is thus necessary for the inventive erection drive.

In principle an erection of the mast with only one cable which is preferably deflected in the middle of the mast is possible. It is particularly preferable according to the invention on the other hand that a plurality of, in particular two, erection cables are provided which extend to the side of the mast. On the one hand the force acting on an individual cable can hereby be reduced and on the other hand a symmetrical introduction of the force onto the mast can be brought about. It is further preferable that a plurality of, in particular two, erection or neck cylinders are provided. The erection cables can then extend at least in sections between the erection cylinders. It can be provided in particular in this connection that the erection cable or the erection cables are connected or fixed to the carrier vehicle in the lateral direction between the erection cylinders.

Having regard to movement it is preferable for the carriage, for the application of the pulling force, in particular for the erection of the mast, to be moved in the direction of a mast base of the mast. Preferably the at least one erection cylinder and the feed drive of the carriage are simultaneously actuated. This facilitates an addition of the erection forces brought about by the erection cylinder and the erection cable.

It is further preferable for the carriage to be moved in the direction of a mast head for lowering the mast. The at least one erection cylinder can thus also be relieved when the mast is lowered.

In a further preferred embodiment of the inventive method it is provided that the pulling force is applied to the erection cable by means of a winch and the carriage is fixed on the mast. In order to erect the mast the erection cable is wound onto a winch which is preferably located on the carrier vehicle.

BRIEF DESCRIPTION OF THE DRAWINGS

The invention is described in more detail below by reference to preferred embodiments which are shown in the attached, schematic drawings, in which.

Corresponding elements are identified in all the drawings with the same reference numerals.

DETAILED DESCRIPTION OF THE PREFERRED EMBODIMENT

Figure 1:
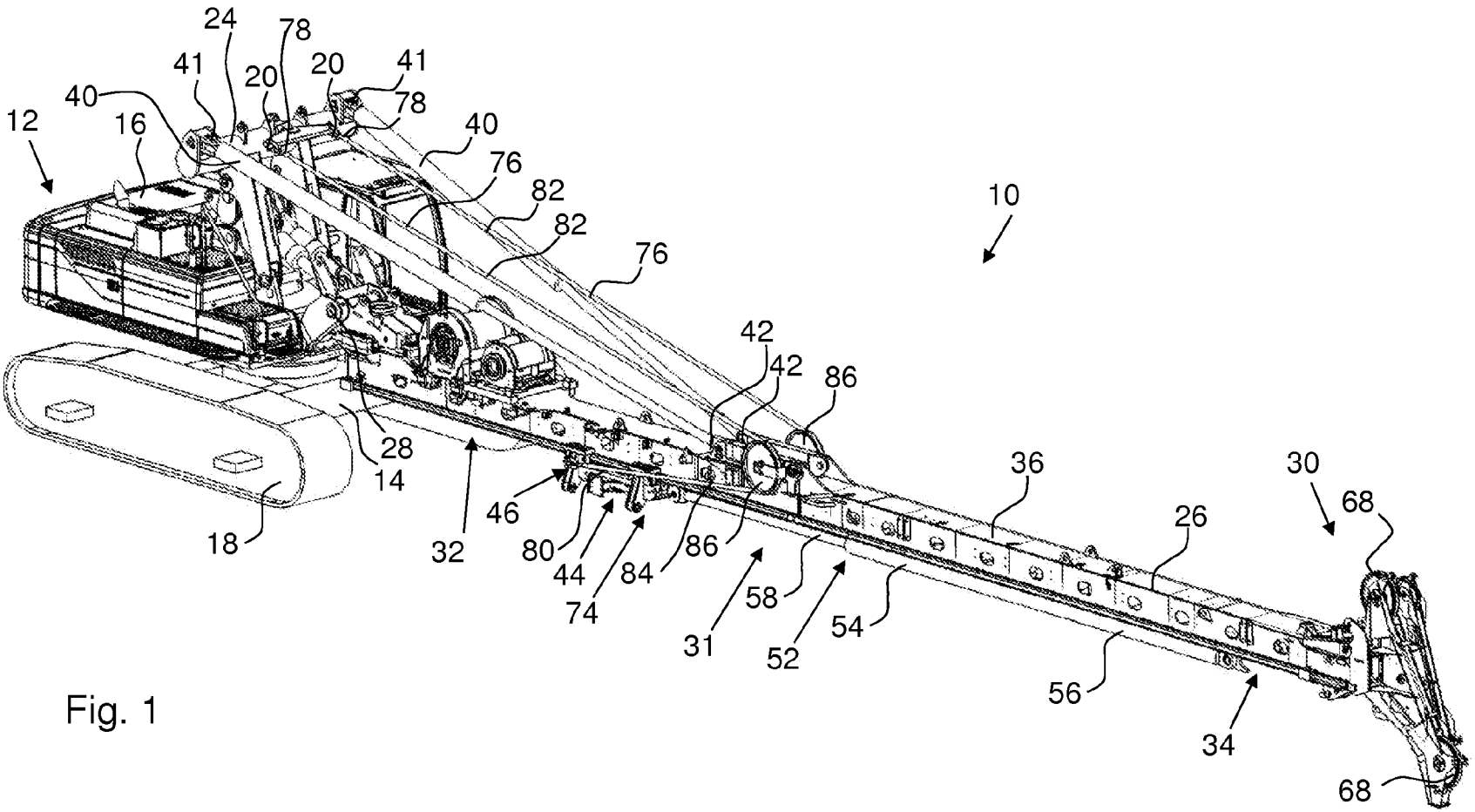
FIG. 1 shows a first embodiment of an inventive construction work unit.
Figure 2:
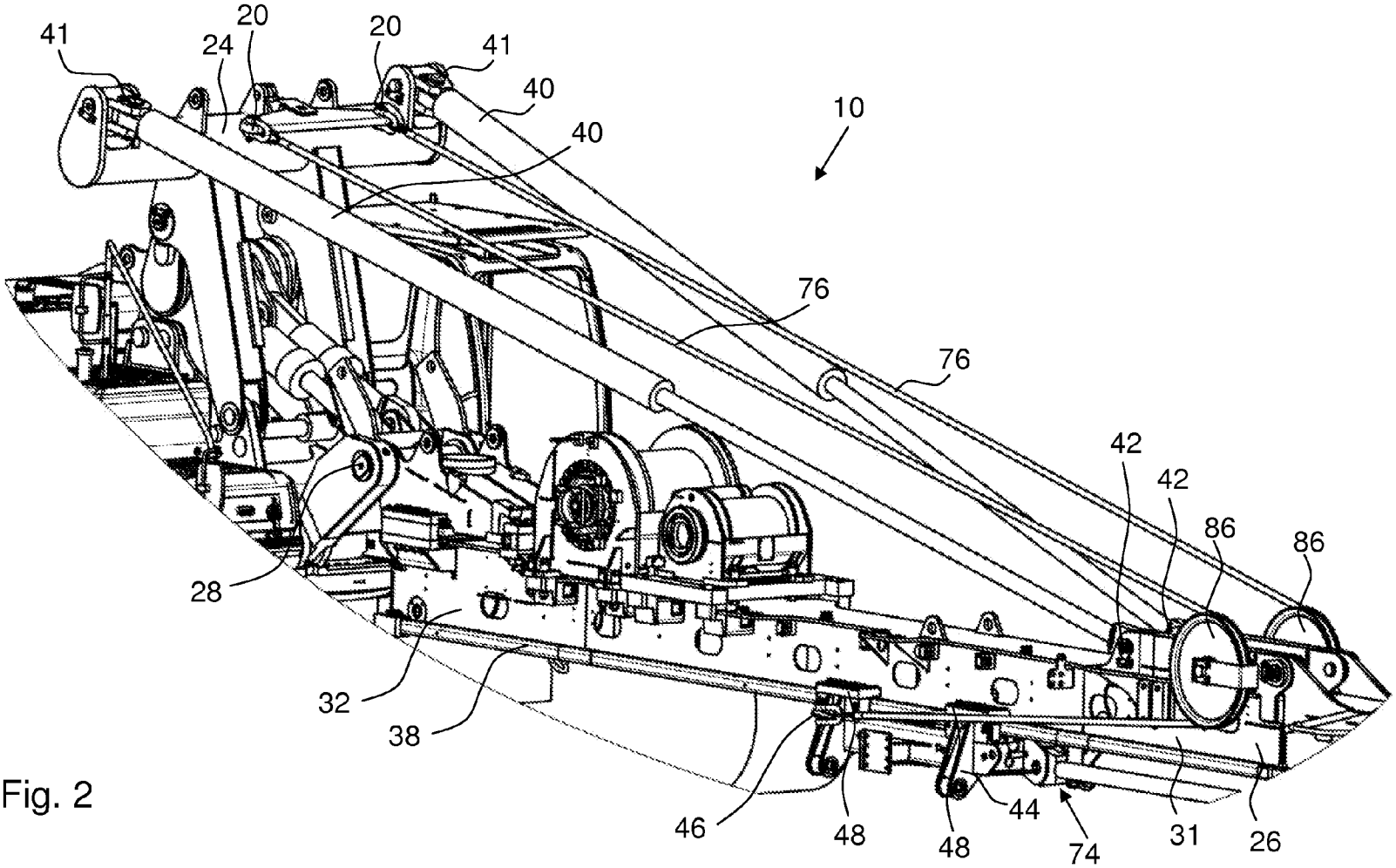
FIG. 2 a detailed cut-out of FIG. 1 in the region of the erection cable, and FIG. 3 a second embodiment of an inventive construction work unit.

FIGS. 1 and 2 show a first embodiment of an inventive construction work unit 10. The construction work unit 10 is a drilling unit with a carrier vehicle 12 which comprises an undercarriage 14 and an upper structure 16 mounted rotatably thereon. The upper structure 16 can be rotated with respect to the undercarriage 14 about a rotation axis extending substantially vertically. The undercarriage 14 comprises a caterpillar 18. A mast 26 is mounted on the upper structure 16 which can be pivoted about a substantially horizontally extending pivot axis 28.

The mast 26 comprises a mast head 30 and a mast base 32, between which a central region 31 of the mast is formed. Deflection pulleys 68, for example for guiding a support cable for a drill rod system, are arranged on the mast head 30.

The pivotable mounting of the mast 26 allows the mast, usually standing vertically in the normal operating position, to be tilted forward into a substantially horizontal transport position. In the transport position the drilling unit 10 accordingly has a reduced height.

In order to erect and lower the mast 26 two erection cylinders 40 are provided which are connected on the one hand to the carrier vehicle 12, in particular the upper structure 16, and on the other hand to the mast 26. The erection cylinders 40, which can also be described as neck cylinders, respectively comprise a base point 41 and an upper connection point 42. They are arranged on a rear side 36 of the mast 26 which forms an upper side of the mast 26 in the transport position. In the operating position of the mast 26, thus in particular during a drilling operation, the cylinders 40 serve to support the mast 26. The erection cylinders 40 are hydraulic cylinders which respectively comprise a cylinder housing and a piston rod mounted displaceably therein.

On a front side 34 of the mast 26 which lies opposite the rear side 36 a carriage 44 is mounted so that it can be displaced longitudinally. In order to guide the carriage 44 the mast 26 comprises guide rails 38 which extend in the longitudinal direction along the mast 26. The carriage 44 comprises guide shoes 48 which are mounted to be longitudinally displaceable on the guide rails 38 of the mast 26. The carriage 44 is a drilling unit carriage, on which a drill drive is arranged in drilling operation.

The carriage 44 can be moved along the mast 26 by means of a feed drive 52, which can also be described as a carriage drive. The feed drive 52 comprises one or more hydraulic feed cylinders 54 which comprise respectively a cylinder housing 56 and a piston rod 58 mounted displaceably therein. The feed cylinder 54 is arranged so that by moving out the piston rod 58 a movement of the carriage 44 in the direction of the mast base 32 is brought about.

In order to support the erection and lowering of the mast 26 through the erection cylinders 40, in addition to the erection cylinders 40, an erection cable drive 74 is provided with two erection cables 76. The erection cables 76 respectively comprise a first cable end 78 which is connected to the carrier vehicle 12 and a second cable end 80 which is connected to the carriage 44 which can be moved along the mast 26.

The erection cables 76 are fixed on the one hand to connection points 20 on the carrier vehicle 12 and on the other hand to connection points 46 on the carriage 44. The connection points 20, 46 constitute in particular cable fixed points. In particular a first cable end 78 is fixed to the carrier vehicle 12 and a second cable end 80 to the carriage 44.

Each erection cable 76 is guided starting from the connection point 20 or cable fixed point on the carrier vehicle 12 initially in the direction of the mast head 30 and is deflected via a cable deflection pulley 86 fixed to the mast 26. At its opposite end it is connected to the connection point 46 on the carriage 44. The connection points 46 are located to the side on the carriage 44. The erection cable 76 has a predefined fixed length between the connection points 20, 46.

The cable deflection pulleys 86 are in the central region 31 of the mast 26 between the mast base 32 and the mast head 30. They are arranged laterally on the mast 26 so that the erection cables 76 are guided to the side of the mast 26. In a starting position in horizontal position of the mast 26 the carriage 44 is arranged below the cable deflection pulleys 86, thus between the cable deflection pulleys 86 and the mast base 32. More specifically, the second connection points 46 or the second cable ends 80 of the carriage 44 are in the starting position of the carriage 44 below, in particular just below, the cable deflection pulleys 86 arranged on the side of the mast 26.

By moving the carriage 44 in the direction of the mast base 32 a pulling force can be exerted on the erection cable 76. Due to the fixing of the first cable end 78 on the carrier vehicle 12 the pulling force exerts an erection force on the cable deflection pulley 86 which is orientated so that the mast 26 is pulled in the direction of its operating position. By moving the carriage 44 in the direction of the mast base 32 the distance between the carriage 44 and cable deflection pulley 86 is enlarged, whereby at the same time by erecting the mast 26 the distance between the cable deflection pulley 86 and the connection point 20 of the erection cable 76 on the carrier vehicle 12 is reduced. A first part length 82 of the erection cable 76 which is formed between the first deflection point 20 and the cable deflection pulley 86 is reduced. At the same time a second part length 84 of the erection cable 76 which is formed between the second connection point 46 and the cable deflection pulley 86 is enlarged.

The erection cables 76 are connected between the base points 41 of the erection cylinders 40 on the carrier vehicle 12. The fixed or connection points 20 for the erection cables 76 are thus between the base points 41 of the erection cylinders. In this connection a fixing block 24 is provided, on which both the erection cylinders 40 and also the erection cables 76 are connected. The fixing block 24 extends substantially transversely to the axis of the mast 26. The base points 41 of the erection cylinders 40 and the erection cables 76 are found substantially at the same height. The fixing block 24 can in particular be a pivot arm mounted on the carrier vehicle 12.

The cable deflection pulleys 86 are arranged directly adjacent to the connection points 42 of the erection cylinders 40 on the mast 26. The erection cable 76 hereby runs in sections parallel to the erection cylinders 40.

In order to erect and/or lower the mast 26 the feed drive 52 which moves the drilling unit carriage 44 during drilling operation along the mast 26 is used to support the erection cylinders 40. The carriage 44 thus serves on the one hand for erection and/or lowering of the mast 26 and on the other hand for moving the drill drive in drilling operation.

For erecting the mast 26 the feed drive 52 is actuated so that the carriage 44 moves beginning from its starting position below the cable deflection pulleys 86 in the direction of the mast base 32. The mast 26 is hereby erected so far until the cable length is unwound or until the carriage 44 has reached a lowermost position on the mast 26 and the erection cylinders 40 can carry out the further erection process, as from this point in time the forces necessary in the erection cylinders 40 are significantly lower due to the more favourable force triangle.

As soon as the carriage 44 is in the lowermost position, in particular after erection of the mast 26, the now loose erection cable 76 can be released from the drilling unit carriage 44. The erection cable 76 can be connected to the side of the mast 26 and serve during the drilling operation as additional security for the mast 26 if the neck cylinders fail.

When tilting the mast 26 the reverse sequence is followed.

Figure 3:
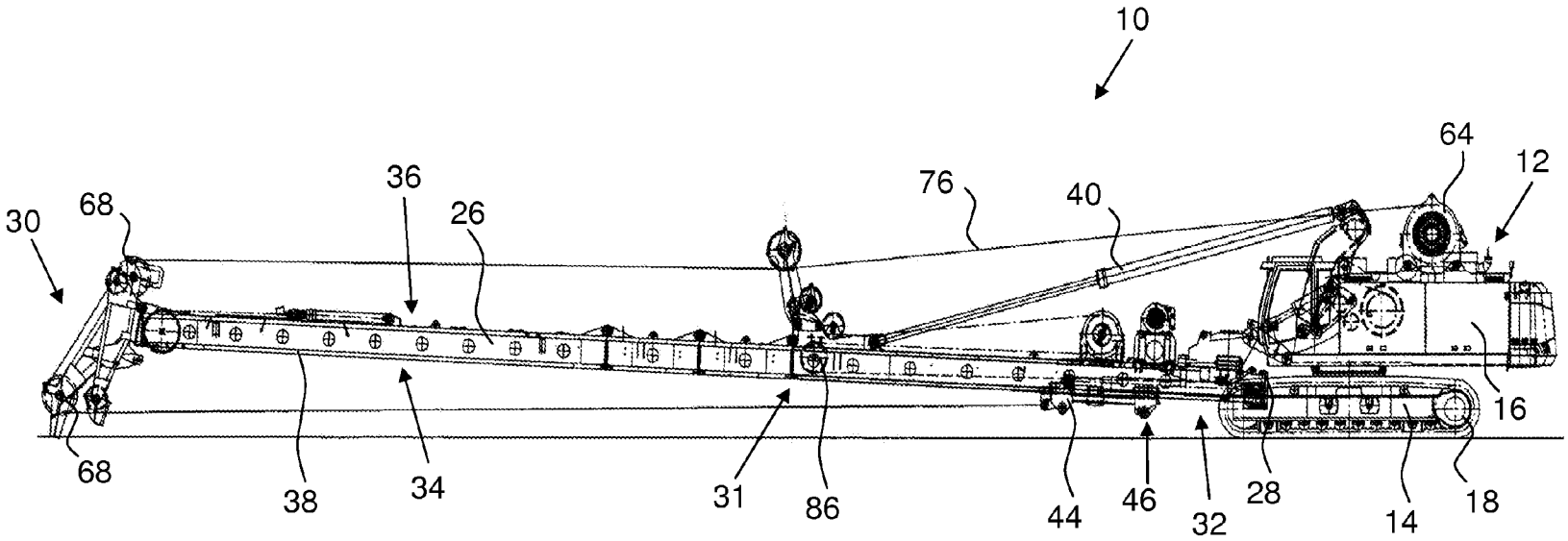

A second embodiment of an inventive construction work unit 10 is shown in FIG. 3.

This embodiment differs from the construction work unit 10 shown in FIGS. 1 and 2 substantially in that the erection force is applied to the erection cable 76 by winding the erection cable 76 onto a cable winch 64 mounted on the carrier vehicle 12. The cable winch 64 can be in particular a so-called main winch of the construction work unit 10. The erection cable 76 can accordingly be described as a main or carrying cable which is used in operation of the construction work unit 10 in particular for handling drill rod system elements. The cable winch 64 or main winch of the carrier vehicle 12 resides preferably in a rear region of the carrier vehicle 12, in particular on the upper structure 16 thereof, while the mast 26 is connected in a front region on the carrier vehicle 12.

When winding the erection cable 76 onto the winch 64 the opposing end of the erection cable 76 is preferably fixed to the carriage 44, as also in the embodiment according to FIGS. 1 and 2. The carriage 44 is preferably fixed in a defined position on the mast 26.

When the mast 26 has reached its operating position the erection cable 76 can be simply released from the carriage 44 by moving the carriage 44 along the mast 26.

In order to erect the mast 26 the erection cable 76, as shown in FIG. 3, can be guided via one or more deflection pulleys 68 on the mast head 30. Alternatively, however, the erection cable 76 can be guided according to the invention also via the cable deflection pulley 86 arranged in the central region 31 of the mast 26.

The invention claimed is:

1. Construction work unit, comprising:

a carrier vehicle, a mast mounted on the carrier vehicle rotatably about a pivot axis, and configured to be pivoted between an erect operating position and an inclined transport position, a carriage configured to be moved along the mast, and at least one erection cylinder and an erection cable which cooperatively pivot the mast between the operating position and the transport position, wherein the erection cable is guided via a cable deflection pulley arranged on the mast and is configured to be arranged at an end on the carrier vehicle and at the other end on the carriage, and by applying a pulling force to the erection cable via the cable deflection pulley an erection force is capable of being transferred to the mast in the direction of its operating position.

2. Construction work unit according to claim 1, further comprising:

a feed drive configured to apply the pulling force to the erection cable for moving the carriage along the mast.

3. Construction work unit according to claim 2, wherein the feed drive comprises a hydraulic feed cylinder or a chain or cable drive.

4. Construction work unit according to claim 1, wherein the erection cable is fixed to two connection points, between which a predefined cable length is formed.

5. Construction work unit according to claim 1, wherein a first part length of the erection cable is formed between a connection point of the erection cable on the carrier vehicle and the cable deflection pulley and a second part length of the erection cable is formed between a connection point of the erection cable on the carriage and the cable deflection pulley, and by moving the carriage along the mast the first part length is capable of being shortened and the second part length correspondingly lengthened or vice versa.

6. Construction work unit according to claim 1, wherein a vehicle-side connection point where the erection cable is connected to the carrier vehicle, the cable deflection pulley and a carriage-side connection point where the erection cable is connected to the carriage form a triangle in the inclined transport position of the mast.

7. Construction work unit according to claim 1, further comprising:

a winch configured to wind up the erection cable for the application of the pulling force to the erection cable.

8. Construction work unit according to claim 1, wherein the erection cable is arranged on the carrier vehicle above the pivot axis of the mast.

9. Construction work unit according to claim 1, wherein the erection cable extends between the carrier vehicle and the cable deflection pulley parallel to the erection cylinder.

10. Construction work unit according to claim 1, wherein the erection cable is fixed releasably on the carriage.

11. Construction work unit according to claim 1, wherein the carriage is formed as a drilling unit carriage, on which a drill drive is configured to be fixed for driving a drill rod system.

12. Construction work unit according to claim 1, wherein two erection cables are provided which extend to the side of the mast.

13. Method for erecting a mast of a construction work unit, which comprises a carrier vehicle, a mast which is connected to the carrier vehicle and is configured to be pivoted between an erect operating position and an inclined transport position, a carriage configured to be moved along the mast, and an erection cylinder and an erection cable which cooperatively pivot the mast between the operating position and the transport position, wherein for the erection of the mast from the transport position into the operating position the erection cylinder is actuated, comprising the steps of:

for the erection of the mast, in addition to the erection cylinder, using the erection cable which at one end is arranged on the carrier vehicle and at the other end on the carriage and guiding the erection cable via a cable deflection pulley arranged on the mast, and applying a pulling force to the erection cable to transfer an erection force to the mast via the cable deflection pulley for the erection of the mast.

14. Method according to claim 13, wherein the carriage is moved for application of the pulling force in the direction of a mast base of the mast.

15. Method according to claim 13, wherein the pulling force is applied to the erection cable by means of a winch and the carriage is fixed to the mast.

* * * * *